US006197406B1

(12) United States Patent
Kwok

(10) Patent No.: US 6,197,406 B1
(45) Date of Patent: Mar. 6, 2001

(54) OMEGA SPRAY PATTERN

(75) Inventor: Kui-Chiu Kwok, Mundelein, IL (US)

(73) Assignee: Illinois Tool Works Inc., Glenview, IL (US)

( * ) Notice: Subject to any disclaimer, the term of this patent is extended or adjusted under 35 U.S.C. 154(b) by 0 days.

(21) Appl. No.: 09/527,432

(22) Filed: Mar. 16, 2000

Related U.S. Application Data

(63) Continuation of application No. 09/143,883, filed on Aug. 31, 1998.

(51) Int. Cl.[7] ..... B32B 3/00

(52) U.S. Cl. ..... 428/195; 428/428; 428/196; 428/343; 428/442; 428/62

(58) Field of Search ..... 428/195, 196, 428/343; 442/62

(56) References Cited

U.S. PATENT DOCUMENTS

| | | |
|---|---|---|
| Re. 33,158 | 2/1990 | Stouffer et al. . |
| Re. 33,159 | 2/1990 | Bauer et al. . |
| Re. 33,448 | 11/1990 | Bauer . |
| Re. 33,481 | 12/1990 | Ziecker et al. . |
| Re. 33,605 | 6/1991 | Bauer . |
| 2,031,387 | 2/1936 | Schwarz . |
| 2,212,448 | 8/1940 | Modigliani . |
| 2,297,726 | 10/1942 | Stephanoff . |
| 2,628,386 | 2/1953 | Tornberg . |
| 3,038,202 | 6/1962 | Harkenrider . |
| 3,176,345 | 4/1965 | Powell . |
| 3,178,770 | 4/1965 | Willis . |
| 3,192,562 | 7/1965 | Powell . |
| 3,192,563 | 7/1965 | Crompton . |
| 3,204,290 | 9/1965 | Crompton . |
| 3,213,170 | 10/1965 | Erdmenger et al. . |

(List continued on next page.)

FOREIGN PATENT DOCUMENTS

| | | |
|---|---|---|
| 19715740 | 10/1998 | (DE) . |
| 756907 | 9/1956 | (GB) . |
| 1392667 | 4/1975 | (GB) . |
| 4416168 | 7/1969 | (JP) . |
| WO9207122 | 4/1992 | (WO) . |
| 9315895 | 8/1993 | (WO) . |

OTHER PUBLICATIONS

Non–Wovens World magazine, Meltblown Technology Today, 1989, pp. 1–158.

The New Non–Wovens World, "Developments in Melt Blowing Technology", 1993, pp. 73–82.

McNally et al., J & M Laboratory, "Durafiber/Durastitch Adhesives Applicaitons Methods Featuring Solid State Application Technology", Sep. 8, 1997 at Inda–Tec 97 Meeting, Cambridge MA, pp. 26.1–26.8.

Gregory F. Ward, "Micro–Denier NonWoven Process and Fabrics", on or about Oct. 1997, pp. 1–9.

(List continued on next page.)

*Primary Examiner*—Christopher Raimund
(74) *Attorney, Agent, or Firm*—Donald J. Breh; Mark W. Croll; John P. O'Brien

(57) ABSTRACT

A method for producing visco-elastic fluidic material flows by drawing a visco-elastic fluidic material with corresponding separate second fluid flows associated therewith to form a visco-elastic fiber vacillating in a repeating, generally omega-shaped pattern having a bowed portion with first and second side portions that first converge toward each other and then diverge outwardly in generally opposing directions. In one operation, the visco-elastic fiber vacillating in the repeating, generally omega-shaped pattern is an adhesive material deposited onto woven and non-woven fabric substrates and stretched elongated elastic strands in the manufacture of a variety of bodily fluid absorbing hygienic articles.

4 Claims, 2 Drawing Sheets

U.S. PATENT DOCUMENTS

| | | |
|---|---|---|
| 3,253,301 | 5/1966 | McGlaughlin . |
| 3,334,792 | 8/1967 | De Vries et al. . |
| 3,380,128 | 4/1968 | Cremer et al. . |
| 3,488,806 | 1/1970 | De Cecco et al. . |
| 3,492,692 | 2/1970 | Soda et al. . |
| 3,501,805 | 3/1970 | Douglas, Jr. et al. . |
| 3,613,170 | 10/1971 | Soda et al. . |
| 3,650,866 | 3/1972 | Prentice . |
| 3,704,198 | 11/1972 | Prentice . |
| 3,755,527 | 8/1973 | Keller et al. . |
| 3,806,289 | 4/1974 | Schwarz . |
| 3,825,379 | 7/1974 | Lohkamp et al. . |
| 3,849,241 | 11/1974 | Butin et al. . |
| 3,861,850 | 1/1975 | Wallis . |
| 3,874,886 | 4/1975 | Levecque et al. . |
| 3,888,610 | 6/1975 | Brackman et al. . |
| 3,920,362 | 11/1975 | Bradt . |
| 3,923,444 | 12/1975 | Esper et al. . |
| 3,942,723 | 3/1976 | Langdon . |
| 3,947,537 | 3/1976 | Buntin et al. . |
| 3,954,361 | 5/1976 | Page . |
| 3,970,417 | 7/1976 | Page . |
| 3,978,185 | 8/1976 | Buntin et al. . |
| 3,981,650 | 9/1976 | Page . |
| 4,007,625 | 2/1977 | Houben et al. . |
| 4,015,963 | 4/1977 | Levecque et al. . |
| 4,015,964 | 4/1977 | Levecque et al. . |
| 4,050,866 | 9/1977 | Kilsdonk . |
| 4,052,002 | 10/1977 | Stouffer et al. . |
| 4,052,183 | 10/1977 | Levecque et al. . |
| 4,100,324 | 7/1978 | Anderson et al. . |
| 4,145,173 | 3/1979 | Pelzer et al. . |
| 4,151,955 | 5/1979 | Stouffer . |
| 4,185,981 | 1/1980 | Ohsato et al. . |
| 4,189,455 | 2/1980 | Raganato et al. . |
| 4,277,436 | 7/1981 | Shah et al. . |
| 4,300,876 | 11/1981 | Kane et al. . |
| 4,340,563 | 7/1982 | Appel et al. . |
| 4,359,445 | 11/1982 | Kane et al. . |
| 4,380,570 | 4/1983 | Schwarz . |
| 4,457,685 | 7/1984 | Huang et al. . |
| 4,526,733 | 7/1985 | Lau . |
| 4,596,346 | 6/1986 | Bauer . |
| 4,645,444 | 2/1987 | Lenk et al. . |
| 4,652,225 | 3/1987 | Dehennau et al. . |
| 4,694,992 | 9/1987 | Stouffer . |
| 4,708,619 | 11/1987 | Balk . |
| 4,746,283 | 5/1988 | Hobson . |
| 4,747,986 | 5/1988 | Chao . |
| 4,785,996 | 11/1988 | Ziecker et al. . |
| 4,812,276 | 3/1989 | Chao . |
| 4,818,463 | 4/1989 | Buehning . |
| 4,818,464 | 4/1989 | Lau . |
| 4,826,415 | 5/1989 | Mende . |
| 4,874,451 | 10/1989 | Boger et al. . |
| 4,889,476 | 12/1989 | Buehning . |
| 4,891,249 | 1/1990 | McIntyre . |
| 4,905,909 | 3/1990 | Woods . |
| 4,923,706 | 5/1990 | Binley et al. . |
| 4,949,668 | 8/1990 | Heindel et al. . |
| 4,955,547 | 9/1990 | Woods . |
| 4,983,109 | 1/1991 | Miller et al. . |
| 5,013,232 | 5/1991 | Way . |
| 5,017,116 | 5/1991 | Carter et al. . |
| 5,035,361 | 7/1991 | Stouffer . |
| 5,066,435 | 11/1991 | Lorenz et al. . |
| 5,067,885 | 11/1991 | Stevenson et al. . |
| 5,069,853 | 12/1991 | Miller . |
| 5,094,792 | 3/1992 | Baran . |
| 5,098,636 | 3/1992 | Balk . |
| 5,114,752 | 5/1992 | Hall . |
| 5,129,585 | 7/1992 | Bauer . |
| 5,145,689 | 9/1992 | Allen et al. . |
| 5,165,940 | 11/1992 | Windley . |
| 5,207,970 | 5/1993 | Joseph et al. . |
| 5,260,003 | 11/1993 | Nyssen et al. . |
| 5,269,670 | 12/1993 | Allen et al. . |
| 5,312,500 | 5/1994 | Kurihara et al. . |
| 5,342,647 | 8/1994 | Heindel et al. . |
| 5,354,378 | 10/1994 | Hauser et al. . |
| 5,407,619 | 4/1995 | Maeda et al. . |
| 5,409,733 | 4/1995 | Boger et al. . |
| 5,418,009 | 5/1995 | Raterman et al. . |
| 5,421,921 | 6/1995 | Gill et al. . |
| 5,421,941 | 6/1995 | Allen et al. . |
| 5,423,935 | 6/1995 | Benecke et al. . |
| 5,429,840 | 7/1995 | Raterman et al. . |
| 5,445,509 | 8/1995 | Allen et al. . |
| 5,458,291 | 10/1995 | Brusko et al. . |
| 5,458,721 | 10/1995 | Raterman . |
| 5,476,616 | 12/1995 | Schwarz . |
| 5,478,224 | 12/1995 | McGuffy . |
| 5,503,484 | 4/1996 | Balk . |
| 5,524,828 | 6/1996 | Raterman et al. . |
| 5,540,804 | 7/1996 | Raterman . |
| 5,605,706 | 2/1997 | Allen et al. . |
| 5,618,347 | 4/1997 | Clare et al. . |
| 5,618,566 | 4/1997 | Allen et al. . |
| 5,620,139 | 4/1997 | Ziecker . |
| 5,679,379 | 10/1997 | Fabbricante et al. . |
| 5,902,540 | 5/1999 | Kwok . |
| 5,904,298 | 5/1999 | Kwok . |

OTHER PUBLICATIONS

Nordson Corp., "Control Coat System", "Control Fiberization Gun", "Meltex", "EP Coating Heads", Metering Technology, Web pp., Apr. 23, 1998, 9 pgs.

Rao et al., "Vibration and Stability in the Melt Blowing Process", 1993 pp. 3100–3111.

Miller, "Beyond Melt Blowing; Process Refinement in Microfibre Hot Melt Adhesive Technology", 1998 11 pgs.

OMEGA SPRAY PATTERN

CROSS REFERENCE TO RELATED APPLICATIONS

The present application is a continuation of Appl. Ser. No. 09/143,883 filed on Aug. 31, 1998 pending and is related to U.S. application Ser. No. 08/843,224 filed on Apr. 14, 1997, entitled "Improved Meltblowing Method and System", now U.S. Pat. No. 5,904,298 and U.S. application Ser. No. 09/060,581 filed on Apr. 15, 1998, entitled "Elastic Strand Coating Process", now U.S. Pat. No. 6,077,375 both all of which are assigned commonly and incorporated herein by reference.

BACKGROUND OF THE INVENTION

The invention relates generally to the dispensing of visco-elastic fluidic materials, and more particularly to methods for producing vacillating visco-elastic fibers for application onto substrates and elongated strands, and combinations thereof.

It is desirable in many manufacturing operations to form visco-elastic fibers or filaments, which are deposited onto substrates and elongated strands moving relative thereto. These operations include the application of fiberized adhesives, including temperature and pressure sensitive adhesives, onto substrates and elongated strands for bonding to substrates. Other operations include the application of non-bonding fiberized visco-elastic materials onto various substrates as protective overlays, for example onto sheet-like articles which are stacked or packaged one on top of another, whereby the non-bonding fiberized material provides a protective overlay or separating member between the stacked articles.

One exemplary bonding operation is the application of substantially continuous adhesive fibers onto woven and non-woven fabric substrates for bonding to other substrates and for bonding to overlapping portions of the same substrate in the manufacture of a variety of bodily fluid absorbing hygienic articles. The adhesive fibers may also be applied to elongated elastic strands for bonding to portions of the substrate, for example in the formation of elastic waste and leg band portions of diapers and other undergarments. Another exemplary adhesive fiber bonding operation is the bonding of paper substrates and overlapping portions of the same substrate in the manufacture of paper packaging, for example disposable paper sacks.

In many adhesive fiber bonding operations, including the exemplary bodily fluid absorbing hygienic article and paper packaging manufacturing operations, as well as many non-bonding operations, it is desirable to uniformly apply the visco-elastic fibers onto the substrate and to accurately control where on the substrate the visco-elastic fibers are applied. The uniform application of visco-elastic fibers onto substrates and elongated strands ensures consistent bonding between substrates, or overlapping layer portions thereof, and elongated strands. The uniform application of visco-elastic fibers onto substrates and elongated strands also economizes usage thereof. Accurately controlling where the visco-elastic fibers are applied onto the substrate ensures proper and complete bonding in areas where bonding is desired, provides a distinct interface between areas of bonding and non-bonding, and generally reduces substrate waste resulting from visco-elastic fibers applied uncontrollably to areas thereof outside or beyond the desired target or bonding areas.

In the manufacture of bodily fluid absorbing hygienic articles, it is desirable to provide maximum absorbency and softness of overlapping bonded substrates and at the same time provide effective bonding therebetween. It is also desirable to bond stretched elongated elastic strands relatively continuously along the axial length thereof for bonding onto substrates so that the stretched strands do not slip, or creep, relative to the substrate when the substrate and strand are later severed in subsequent fabrication operations. More generally, it is desirable to accurately and uniformly apply visco-elastic fibers onto substrates and elongated strands, without undesirable overlapping of adjacent fibers, and with well defined, or distinct, interfaces between substrate areas with and without fiber coverage. Similar results are desirable in the application of bonding and non-bonding fibers onto substrates and elongated strands used in operations besides the exemplary manufacture of hygienic articles.

In the past, visco-elastic fibers have been applied onto substrates with melt blowing and spiral nozzles. Conventional melt blowing and spiral nozzles however do not adequately satisfy all of the requirements in the manufacture of bodily fluid absorbing hygienic articles and other operations discussed generally above, or do so to a limited extent using adhesive excessively and inefficiently. Melt blowing nozzles generally dispense fibers chaotically in overlapping patterns, and spiral nozzles dispense fibers in overlapping spiral patterns. The fiber patterns produced by these conventional nozzles tend to stiffen the substrate, which is particularly undesirable in the manufacture of bodily fluid absorbing hygienic articles. The fiber patterns produced by conventional nozzles also tend to reduce the puffiness and hence softness of bonded substrates, or fabrics, which reduces the comfort thereof. Additionally, fiber patterns produced by conventional nozzles tend to reduce the absorbency of fabrics by obstructing the flow of moisture between layers, usually from the inner layers toward more absorbent outer layers. The conventional nozzles also apply fibers onto the substrate relatively non-uniformly, and lack precise control over where the fibers are applied onto substrates and elongated strands.

The present invention is drawn toward advancements in the art of producing visco-elastic fluidic material flows, and more particularly to methods for producing vacillating visco-elastic fibers for application onto substrates and elongated strands, and combinations thereof.

It is an object of the invention to provide novel methods for producing vacillating visco-elastic fluidic material flows for application onto various substrates and elongated strands and combinations thereof that overcome problems in the art.

It is another object of the invention to provide novel methods for producing vacillating visco-elastic fluidic material flows for application onto various substrates and elongated strands and combinations thereof having one or more advantages over the prior art, including relatively improved control over where the fibers are deposited onto substrates and elongated strands, relatively uniform application of the fibers onto substrates and elongated strands, and economizing usage of the fibers and drawing gases associated with the application thereof.

It is another object of the invention to provide novel methods for producing vacillating visco-elastic fibers for application onto various substrates and elongated strands and combinations thereof, especially in the manufacture of bodily fluid absorbing hygienic articles. And it is a related object to provide bodily fluid absorbing hygienic articles having well bonded woven and/or non-woven substrates with improved absorbency and softness.

It is a more particular object of the invention to provide novel methods for producing visco-elastic fluidic material flows comprising generally drawing a visco-elastic fluidic material with corresponding separate second fluid flows associated therewith to form a visco-elastic fiber vacillating in a repeating, generally omega-shaped pattern having a bowed portion with first and second side portions that first converge toward each other and then diverge outwardly in generally opposing directions.

It is another more particular object of the invention to provide novel methods for producing visco-elastic fluidic material flows comprising generally drawing a visco-elastic fluidic material with corresponding separate second fluid flows associated therewith to form a visco-elastic fiber vacillating in a repeating, generally omega-shaped pattern, and depositing the vacillating visco-elastic fiber onto substrates and/or elongated strands moving relative thereto, and combinations thereof. It is a related object of the invention to deposit the vacillating visco-elastic fiber onto one or more stretched elongated elastic strands disposed on a substrate for adhering, or stitching, the stretched elongated elastic strands to the substrate substantially continuously along the axial length thereof.

These and other objects, aspects, features and advantages of the present invention will become more fully apparent upon careful consideration of the following Detailed Description of the Invention and the accompanying Drawings, which may be disproportionate for ease of understanding, wherein like structure and steps are referenced generally by corresponding numerals and indicators.

DETAILED DESCRIPTION OF THE INVENTION

Figure 1:
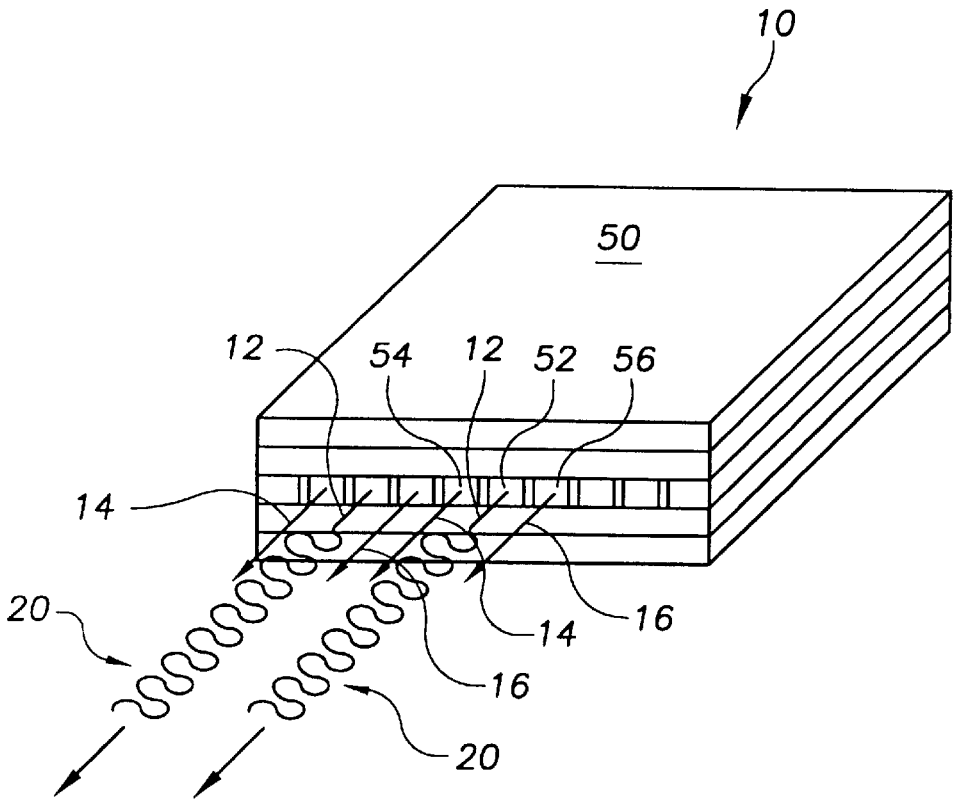
FIG. 1 is an apparatus for producing a visco-elastic fiber vacillating in a repeating, generally omega-shaped pattern according to the present invention.

FIG. 1 is an apparatus 10 for producing one or more visco-elastic fluidic material flows, or fibers, 20, which may be deposited onto substrates or elongate strands and which are useable in various bonding and non-bonding operations. The visco-elastic fluidic material is, for example, a polyethylene or polypropolene or other polymer formulated for bonding and/or non-bonding applications. These visco-elastic materials however are exemplary only, and are not intended to be limiting since any visco-elastic fluidic material that may be drawn into relatively continuous fibers or filaments are suitable for practicing the present invention.

In one exemplary operation, the visco-elastic fluidic material is a temperature or pressure sensitive adhesive useable for bonding overlapping substrates. These operations include, for example, applying adhesive fibers onto woven and non-woven substrates in the manufacture of bodily fluid absorbing hygienic articles, and onto paper substrates in the manufacture of paper packaging materials, and onto various other substrates, which are bonded with other substrates or with elongated strands. In another exemplary application, the visco-elastic fluidic material is a non-adhesive material deposited onto other substrates in non-bonding operations, for example as protective overlays between substrates, like glass and other materials.

Figure 2:
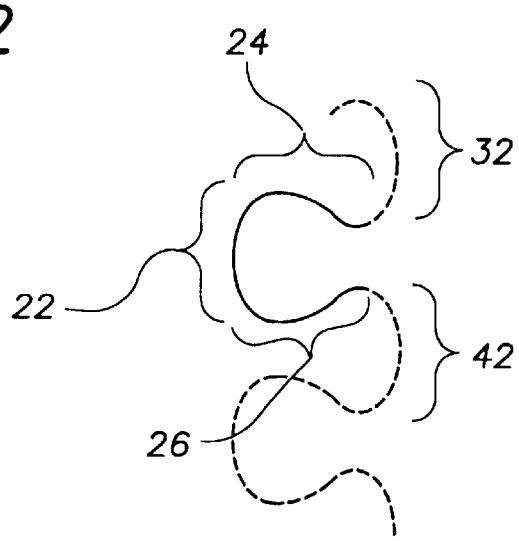
FIG. 2 is a partial view of the repeating, generally omega-shaped visco-elastic fiber pattern.

FIG. 1 illustrates the nozzle 10 producing a visco-elastic fiber 20 in a repeating, generally omega-shaped pattern. FIG. 2 illustrates a segment of the repeating, generally omega-shaped pattern having a bowed portion 22 with first and second side portions 24 and 26 each shared with corresponding adjacent bowed portions 32 and 42 of adjacent segments of the pattern, which are illustrated in phantom lines. The first and second side portions 24 and 26 first converge toward each other and then diverge outwardly in generally opposing directions before merging with the corresponding adjacent bowed portions 32 and 42. According to the present invention, the repeating, generally omega-shaped pattern of the fibers 20 are produced remarkably consistently and uniformly, and are particularly well suited for many bonding and non-bonding operations with significant advantages over conventional overlapping chaotic and spiral fiber patterns produced by conventional nozzles.

In FIG. 1, the repeating, generally omega-shaped pattern of the visco-elastic fiber 20 is produced generally by dispensing a visco-elastic fluidic material to form a first fluid flow 12 at a first velocity, and dispensing a second fluid to form separate second fluid flows 14 and 16 at a second velocity along generally opposing flanking sides of the first fluid flow 12. The separate second fluid flows 14 and 16 are located and oriented relative to the first fluid flow 12 to vacillate the first fluid flow 12 in a manner that produces the repeating, generally omega-shaped pattern.

The second fluid flows 14 and 16, which are preferably a gas like air, are spaced from the first fluid flow 12 and dispensed at a second velocity greater than a first velocity of the first fluid flow 12 so that the first fluid flow 12 is drawn by the separate second fluid flows and vacillated to form the visco-elastic fiber in the repeating, generally omega-shaped pattern 20 illustrated in FIGS. 1 and 2. The first fluid flow 12 and the separate second fluid flows 14 and 16 are preferably dispensed in a common plane, whereby the first fluid flow is vacillated to form the repeating generally omega-shaped pattern in the common plane containing the first and separate second fluid flows, illustrated best in FIG. 1. In one mode of operation, the separate second fluid flows 14 and 16 are converged toward the first fluid flow 12 to form the fiber in the repeating, generally omega-shaped pattern 20. And in another alternative mode of operation, the separate second fluid flows 14 and 16 are dispensed parallel to the first fluid flow 12 to form the fiber in the repeating, generally omega-shaped pattern 20.

Generally, as the second velocity of the separate second fluids flows 14 and 16 increases relative to the first velocity of the first fluid flow 12, the first fluid flow 12 is correspondingly drawn increasingly and begins to vacillate back and forth with correspondingly increasing amplitude and frequency, as disclosed generally and more fully in copending U.S. application Ser. No. 08/843,224 filed on Apr. 14, 1997, entitled "Improved Meltblowing Method and System", now U.S. Pat. No. 5,904,298 incorporated herein by reference. As the second velocity of the separate second fluid flows 14 and 16 increases further relative to the first velocity of the first fluid flow 12, the first fluid flow 12 begins to vacillate in the desired repeating, generally omega-shaped pattern 20. Further increases in the second velocity of the separate second fluid flows 14 and 16 relative to the first velocity of the first fluid flow 12 eventually results in a generally chaotic vacillation of the visco-elastic fiber, which may be desirable for some operations but is beyond the scope of the present application.

FIG. 1 illustrates the visco-elastic fluidic material dispensed from a first orifice 52 in a body member 50, or die assembly, to form the first fluid flow 12, and the second fluid dispensed from two second orifices 54 and 56 in the body member 50 associated with the first orifice 52. The two second orifices 54 and 56 are disposed on generally opposing flanking sides of the first orifice 52, in a common plane, to form the separate second fluid flows 14 and 16 along generally opposing flanking sides of the first fluid flow 12. The body member 50 is preferably a parallel plate body member as disclosed generally and more fully in the copending U.S. application Ser. No. 08/843,224 filed on Apr. 14, 1997, entitled "Improved Meltblowing Method and System", now U.S. Pat. No. 6,077,375, incorporated herein by reference.

In one exemplary adhesive dispensing operation suitable for the manufacture of bodily fluid absorbing hygienic articles, the orifices of the parallel plate die assembly are generally rectangular. More particularly, the adhesive orifices are approximately 0.022 inches by approximately 0.030 inches and the corresponding separate air orifices are approximately 0.033 inches by approximately 0.030 inches. In the exemplary adhesive dispensing operation, the adhesive mass flow rate is approximately 10 grams per minute per adhesive orifice, and the air mass flow rate is approximately 0.114 cubic feet per minute for the two corresponding air orifices. Under these exemplary operating conditions, a repeating, generally omega-shaped pattern having a width, or amplitude, of approximate 0.25 inches is produced when the air pressure is between approximately 3 pounds per square inch (psi) and approximately 10 psi, with a preferable operating air pressure of approximately 6 psi. The air temperature is generally the same as or greater than the adhesive temperature, and may be adjusted to control the adhesive temperature, which is usually specified by the manufacturer.

These exemplary die orifice specifications are not intended to be limiting, and may be varied considerably to produce the repeating, generally omega-shaped pattern. The orifices may be formed in more conventional non-parallel plate die assemblies, and may be circular rather than rectangular. The air and adhesive mass flow rates, as well as the air pressure required to produce the repeating, generally omega-shaped pattern may also be varied outside the exemplary ranges. For example, the width of the amplitude and weight of the repeating, generally omega-shaped patterns 20 may be varied by appropriately selecting the air and adhesive orifice sizes and the controlling the air and adhesive mass flow rates. For many adhesive dispensing operations the amplitude of the repeating, generally omega-shaped pattern is generally between approximately 0.125 and 1 inches, but may be more or less.

A body member 50, or die assembly, configured and operated as discussed above produces remarkably uniform and consistent repeating, generally omega-shaped pattern 20. Additionally, the amplitude and frequency of the repeating, generally omega-shaped patterns 20 may be controlled relatively precisely as discussed above and more fully in the copending U.S. application Ser. No. 08/843,224 filed on Apr. 14, 1997, entitled "Improved Meltblowing Method and System", now U.S. Pat. No. 5,904,298, incorporated herein by reference. Thus the repeating, generally omega-shaped pattern may be deposited onto a substrate or elongated strand with substantial uniformity and accuracy not heretofore available with conventional fiber or filament dispensing nozzles.

Figure 3:
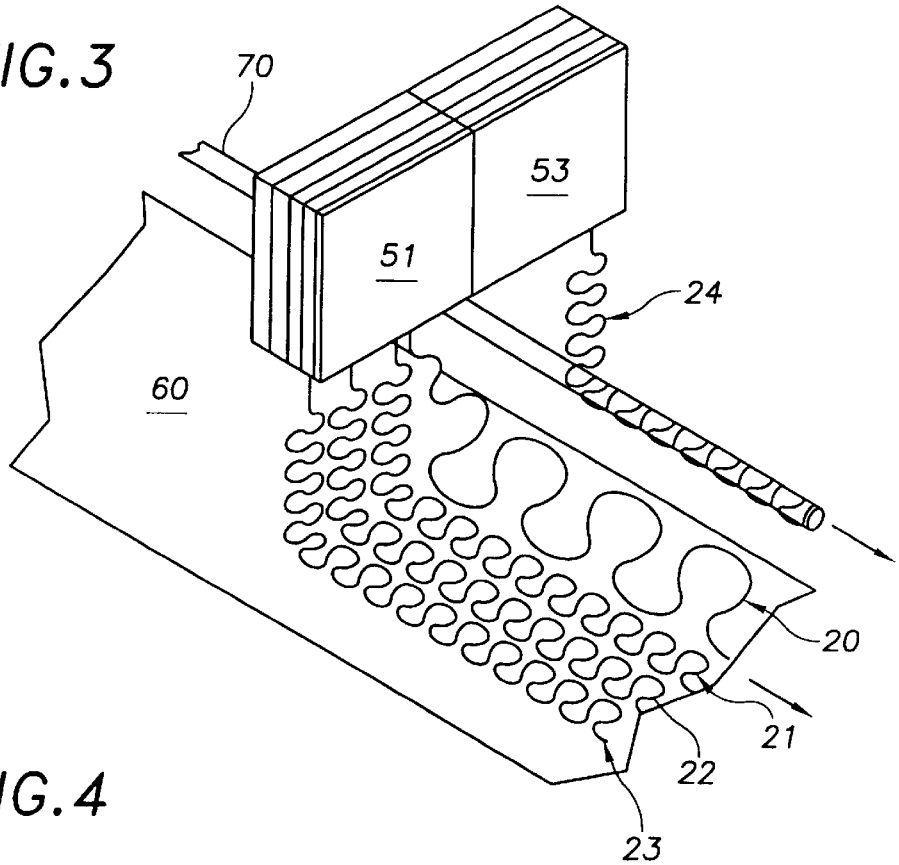
FIG. 3 is an exemplary application of visco-elastic fibers vacillating in repeating, generally omega-shaped patterns onto a substrate and an elongated strand.

FIG. 3 illustrates a first parallel plate die assembly 51 having nozzles for depositing multiple repeating, generally omega-shaped patterns 20 with differing amplitudes onto a substrate 60 moving relative thereto in a substrate coating operation. An alternative and equivalent is for the die assembly 51 to move relative to a fixed substrate. In the exemplary embodiment, the first fluid flows forming the repeating, generally omega-shaped patterns 20 are vacillated non-parallel to the movement direction of the substrate by the corresponding second fluid flows, and more particularly the first fluid flows are vacillated transversely to the movement direction of the substrate 60. This aspect of the invention is disclosed more fully in the copending U.S. application Ser. No. 08/843,224 filed on Apr. 14, 1997, entitled "Improved Meltblowing Method and System", now U.S. Pat. No. 5,904,298, incorporated herein by reference.

According to the present invention, the repeating, generally omega-shaped patterns 20 may be deposited relatively continuously onto a surface of the substrate in single or multiple parallel patterns, which selectively cover the substrate as desired for the particular application. In FIG. 3 for example, two or more repeating, generally omega-shaped patterns 21, 22 and 23 may be applied to the substrate 60 side-by-side providing relatively complete substrate coverage without undesirable overlapping therebetween. And in operations where some overlapping of adjacent fiber patterns 20 is desired, the extent of the overlap can be controlled relatively precisely in the practice of the present invention. This is due in part to the relatively consistent width of the fibers 20 produced, and also to the location accuracy with which the fibers 20 are applied onto the substrate.

Figure 4:
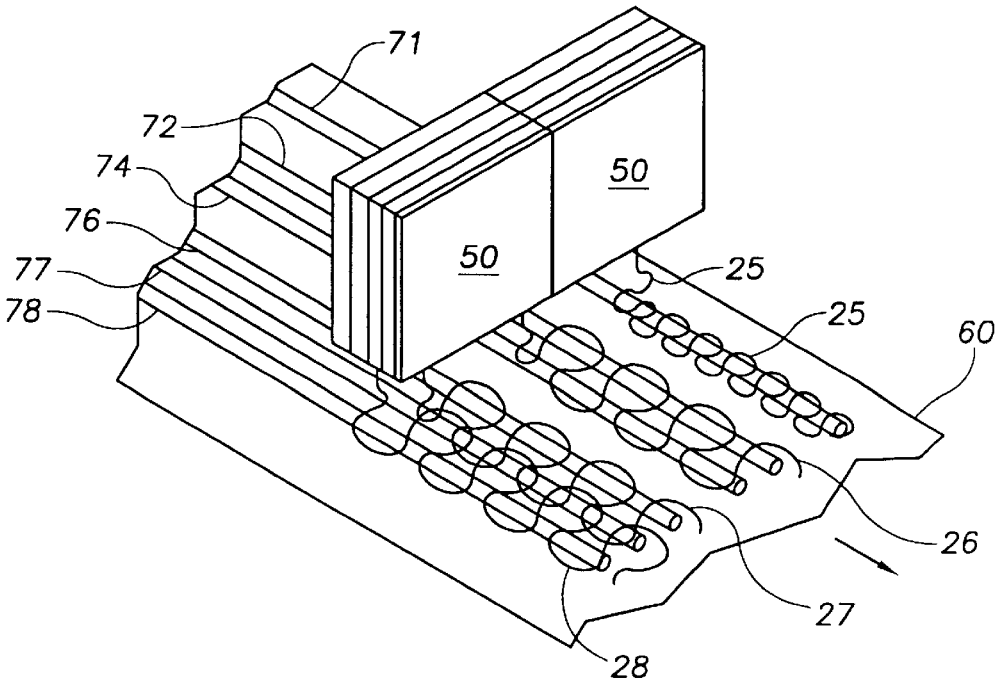
FIG. 4 is another exemplary application of visco-elastic fibers vacillating in repeating, generally omega-shaped patterns onto substrates and elongated strands.

FIGS. 3 and 4 illustrate also how the repeating, generally omega-shaped fiber patterns 20 provide excellent bonding without compromising absorbency and softness of the substrate, which is so desirable when bonding woven and non-woven fabric substrates in the manufacture of bodily fluid absorbing hygienic articles. More particularly, the repeating, generally omega-shaped fiber patterns 20 provide uniform substrate coverage with substantial adhesive bonding area, yet fiber overlapping is eliminated or at least reduced substantially where undesired. Thus the tendency of the fabric to stiffen due to globular and overlapping fibers is eliminated. The repeating, generally omega-shaped fiber patterns 20 also provide relatively large areas of adhesive non-coverage through which bodily fluids may flow unobstructed. These large areas of adhesive non-coverage also reduce the tendency of the woven and non-woven fabric substrates to flatten and lose puffiness, which otherwise occurs with fibers produced by conventional nozzles, thereby increasing the softness of the bonded substrates.

FIG. 3 also illustrates a second parallel plate die assembly 53 depositing a repeating, generally omega-shaped fiber pattern 24 onto at least one isolated elongated strand 70 moving relative thereto in a strand coating operation. An alternative and equivalent is for the die assembly 53 to move relative to a fixed strand. According to the strand coating operation, the repeating, generally omega-shaped pattern is vacillated generally non-parallel, and in the exemplary operation transversely to, a direction of movement of the isolated elongated strand 70. The uniformity and consistency of the repeating, generally omega-shaped pattern ensures relatively uniform application thereof along the axial dimension of the elongated strand, which is particularly desirable in operations where the strand is a stretched elongated elastic strand subsequently bonded to some other substrate, thereby reducing the tendency of the bonded elongated strand 70 to thereafter creep relative to the substrate 60 when severed during subsequent fabrication operations. More generally, at least one repeating, generally omega-shaped fiber pattern may be deposited onto two or more isolated elongated strands moving relative thereto in a strand coating operation. Alternatively, multiple adjacent or overlapping repeating, generally omega-shaped fiber patterns may be deposited onto two or more isolated elongated strands moving relative thereto in a strand coating operation.

In one operation, the amplitude or width of the repeating, generally omega-shaped pattern 24 is selected so that substantially all of the visco-elastic material vacillating in the repeating, generally omega-shaped pattern is captured on or about an isolated elongated strand 70 as disclosed generally and more fully in the copending U.S. application Ser. No. 09/060,581 filed on Apr. 15, 1998, entitled "Elastic Strand Coating Process", now U.S. Pat. No. 6,077,375, incorporated herein by reference. The uniform width of the repeating, generally omega-shaped pattern 24 and the accuracy with which it is deposited makes possible the capture of substantially all of the fiber 24 onto the elongated strand 70, which is highly desirable in manufacturing operations and is a significant advantage over conventional elongated strand bonding operations.

FIG. 4 illustrates another alternative operation wherein a repeating, generally omega-shaped fiber pattern 25 is deposited onto at least one corresponding elongated strand 71, which may be a stretched elongated elastic strand, disposed either directly on the substrate 60, or raised thereabove. The uniformity and consistency of the repeating, generally omega-shaped pattern ensures relatively uniform application thereof along the axial dimension of the at least one elongated strand 71. Also, the amplitude or width of the repeating, generally omega-shaped pattern 25 may be selected so that the repeating, generally omega-shaped fiber pattern just covers the elongated strand 71 widthwise, for example in a bonding operation whereby the fiber is an adhesive material, so that the elongated strand 71 is effectively stitched to the substrate 60.

In another operation, a single repeating, generally omega-shaped pattern 26 may be deposited onto two or more elongated strands 72 and 74 disposed either directly on the substrate 60, or raised thereabove. And in other operations, two or more repeating, generally omega-shaped patterns 27 and 28 may be deposited, either adjacently or overlappingly, as illustrated, onto multiple elongated strands 76, 77 and 78 disposed either directly on the substrate 60, or raised thereabove. The width and weight of the repeating, generally omega-shaped fiber patterns, and the location of deposition thereof onto the strand and/or substrate of course, depends on the configuration of the die assembly 50 as discussed hereinabove.

While the foregoing written description of the invention enables one of ordinary skill to make and use what is considered presently to be the best mode thereof, those of ordinary skill will understand and appreciate the existence of variations, combinations, and equivalents of the specific exemplary embodiments herein. The invention is therefore to be limited not by the exemplary embodiments herein, but by all embodiments within the scope and spirit of the appended claims.

What is claimed is:

1. An article of manufacture comprising:

a substrate having a first surface;

a substantially continuous visco-elastic fiber disposed on the first surface of the substrate, the substantially continuous visco-elastic fiber formed in a repeating generally omega-shaped pattern, the generally omega-shaped pattern having a bowed portion with first and second side portions, the first and second side portions converging toward each other and then diverging outwardly in generally opposing directions.

2. The article of claim 1 further comprising the substrate is a fabric material useable in the manufacture of bodily fluid absorbing hygienic articles.

3. The article of claim 1 further comprising the substrate is a paper material useable in the manufacture of packaging.

4. The article of claim 1 further comprising a plurality of substantially continuous visco-elastic fibers disposed on the first surface of the substrate, each of the substantially continuous visco-elastic fibers formed in a repeating generally omega-shaped pattern and arranged generally parallel.

* * * * *